United States Patent [19]

Peck et al.

[11] 4,185,164

[45] Jan. 22, 1980

[54] VOLTAGE FEED THROUGH APPARATUS HAVING REDUCED PARTIAL DISCHARGE

[76] Inventors: Robert A. Frosch, Administrator of the National Aeronautics and Space Administration, with respect to an invention of Stephen R. Peck, King of Prussia; Jeffrey W. Benham, Jeffersonville, both of Pa.

[21] Appl. No.: 868,249

[22] Filed: Jan. 10, 1978

[51] Int. Cl.[2] ..... H01B 17/26; H01B 17/44

[52] U.S. Cl. ..... 174/142; 174/73 R

[58] Field of Search ..... 174/73 R, 73 SC, 142, 174/120 SC, 110 S, 140 R, 152 R

[56] References Cited

U.S. PATENT DOCUMENTS

| | | | |
|---|---|---|---|
| 2,379,942 | 7/1945 | Webber | 174/73 R |
| 3,047,448 | 7/1962 | Feller et al. | 174/110 S X |
| 3,096,210 | 7/1963 | Boonstra | 174/120 SC X |
| 3,297,855 | 1/1967 | Bowers | 174/126 CP X |
| 3,420,945 | 1/1969 | Finke et al. | 174/142 X |
| 3,471,628 | 10/1969 | Harmon | 174/73 R X |
| 4,031,311 | 6/1977 | Mazanek | 174/152 R X |

FOREIGN PATENT DOCUMENTS

| | | | |
|---|---|---|---|
| 213978 | 4/1924 | United Kingdom | 174/142 |

*Primary Examiner*—Bruce A. Reynolds
*Assistant Examiner*—E. Frederick Borchelt
*Attorney, Agent, or Firm*—Robert D. Marchant; John R. Manning; John O. Tresansky

[57] ABSTRACT

A voltage feed-through apparatus having reduced partial discharge having an electrical conductor and an electrical terminal connected thereto. A semi-conductor sleeve surrounds the conductor for reducing the electric field concentration at the metallic conductor surface and consequently reducing the partial discharge occurrences. An insulator sleeve encircles the semi-conductor sleeve. A metallic sleeve surrounds a portion of the terminal. Another insulator is connected to the metallic sleeve and surrounds a portion of the insulator sleeve forming a space therebetween. Another metallic sleeve spaced from the first metallic sleeve surrounds a portion of the other insulator.

6 Claims, 4 Drawing Figures

VOLTAGE FEED THROUGH APPARATUS HAVING REDUCED PARTIAL DISCHARGE

ORIGIN OF THE INVENTION

The invention described herein was made in the performance of work under a NASA contract and is subject to the provision of section 305 of the National Aeronautics and Space Act of 1958, Public Law 85-568 (72 STAT. 435; 42 USC 2457) and may be manufactured and used by or for the Government for governmental purposes without the payment of any royalties thereon or therefor.

BRIEF SUMMARY OF THE INVENTION

This invention relates generally to voltage feed through apparatuses and more particularly to a voltage feed through device having a reduced partial discharge charge threshold level.

Partial discharge is the phenomenon that results when a gas is subjected to an electric field and is ionized. This ionization results when the potential gradient exceeds a certain value across a specific distance and at a specific pressure but is insufficient to cause high energy breakdown as minifested in a self-supporting glow discharge. When testing electrical equipment it is often necessary to determine the number of partial discharge occurrences produced by the equipment when subjected to voltage magnitudes which exceed the ionizing potential as a function of distance and pressure between surfaces.

When confronted with the partial discharge experienced by electrical equipment which is used in a vacuum environment, such as spacecraft, nuclear accelerators and vacuum sputtering processes, it becomes necessary to test this equipment in vacuum chambers prior to its use in space or within other vacuum systems. For partial discharge measurements to be accomplished in the vacuum chamber it is essential to make high voltage penetrations through the vacuum chamber wall. To obtain accurate partial discharge data on the equipment to be used in the spacecraft and other vacuum environments it is required that only very low energy partial discharges occur within the high voltage vacuum feed-through apparatus penetrations.

Previously, conventional high voltage vacuum feed-through penetrations were used as the connection through the vacuum chamber walls. Such devices use a copper conductor for carrying the high voltage to the equipment being tested. These copper conductors although appearing smooth actually have many surface irregularities. A ceramic insulator surrounds the copper conductor creating many small random trapped air pockets therebetween. The ceramic insulator is connected to a metallic flange which is connected to the outside wall of the vacuum chamber.

The disadvantage of these prior art devices is that the surface irregularities on the copper conductor and the trapped air pockets between the insulator and the conductor concentrate the electric field at these irregularities and air pockets. These field concentrations produce many moderate to high partial discharges which swamp out and mask the energetic discharges produced within the test sample in vacuum and measured by the partial discharge detection equipment outside of the vacuum system.

In tests conducted on these prior art devices it was determined that they produced more than two million partial discharge occurrences at levels higher than 1.85 picocoulombs during a 200 second acquisition time with 20 KVDC applied to the devices. To obtain accurate data on the equipment being tested in the vacuum chamber it is desired that the partial discharge occurrences produced by the feed through devices be reduced by a factor of $10^4$. Consequently, when voltage feed-through penetrations are used with a vacuum chamber and subjected to a vacuum pressure of greater than $10^{-5}$ torr, 20 KVDC applied to the conductor and an acquisition time of 200 seconds no more than 5 partial discharge occurrences greater than 5 picocoulombs can be allowed without effecting the accuracy of the required data. The prior art devices cannot reduce the partial discharge occurrences to this level.

Briefly, these and other disadvantages are overcome by providing a voltage feed-through apparatus with an electrical conductor having an electrical terminal connected at one end. A semi-conductor sleeve surrounds the conductor for reducing the electrical field concentration at the electrical conductor surface, thereby reducing the number of partial discharge occurrences. An electrical insulator sleeve surrounds the semi-conductor sleeve for electrically insulating the conductor. A metallic sleeve surrounds a portion of the terminal. Another insulator is connected to the metallic sleeve and surrounds a portion of the insulator sleeve forming a space therebetween. Another metallic sleeve spaced from the first metallic sleeve surrounds a portion of the other insulator.

Accordingly, one object of the invention is to provide a new and improved voltage feed-through device.

Another object of this invention is to provide a voltage feed-through device with reduced partial discharge susceptibility. Still another object of the invention is to provide a voltage feed-through device with reduced electrical field concentrations around the surface of the high voltage conductor.

A further object of the present invention is to provide a voltage feed-through device which reduces partial discharge occurrences to a magnitude of not more than 5 partial discharge occurrences greater than 5 picocoulombs when subjected to a presure of less than $10^{-5}$ torr at 20 KVDC and an acquisition time of 200 seconds.

The above and further objects and novel features of the invention will apper more fully from the following detailed description when read in conjunction with the accompanying drawings.

BRIEF DESCRIPTION OF THE DRAWINGS

In the drawings where like parts are designated by the same references.

DESCRIPTION OF THE PREFERRED EMBODIMENT

Figure 1:
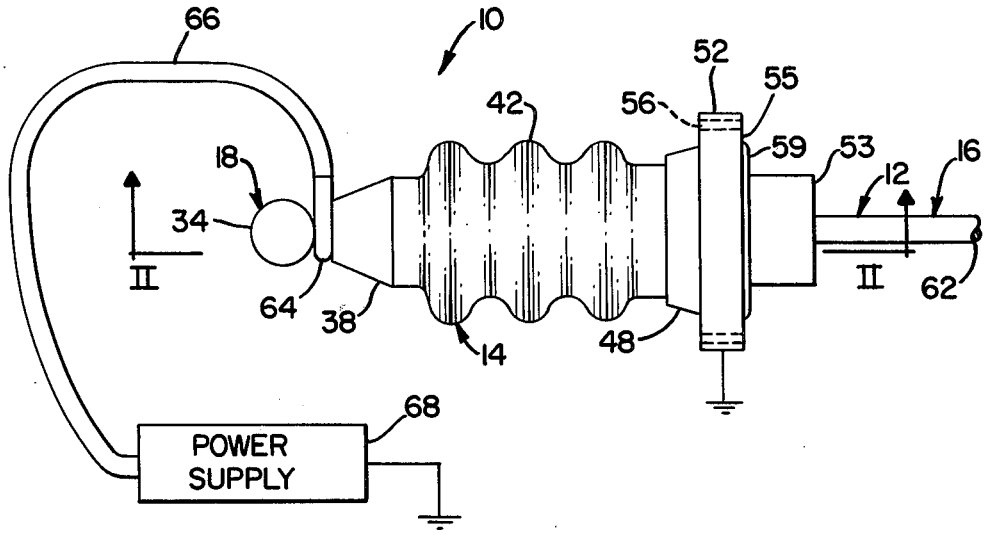
FIG. 1 is a side view of the voltage feed-through apparatus having reduced partial discharge of the present invention.

FIG. 1 illustrates a voltage feed-through apparatus having reduced partial discharge, generally designated by numeral 10, which includes an insulated electrical conductor, generally designated by numeral 12, and an electrical insulator, generally designated by numeral 14.

Figure 2:
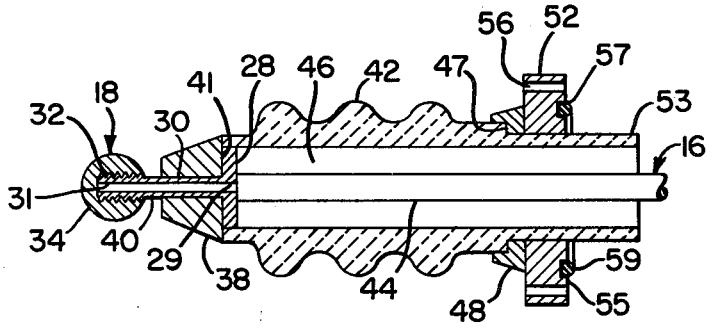
FIG. 2 is a side view in cross section of the apparatus of FIG. 1 taken along the lines of II—II showing the internal parts of the invention.
Figure 3:
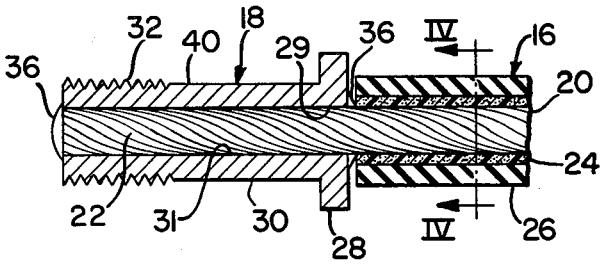
FIG. 3 is an enlarged cross-sectional view of the electrical cable of FIG. 2 showing the conductor, semi-conductor and insulation and showing the conductor connection to the terminal.
Figure 4:
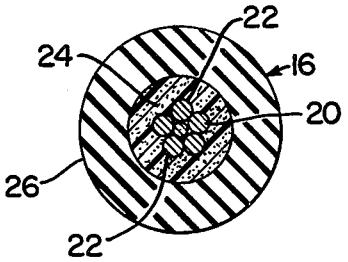
FIG. 4 is an enlarged cross-sectional view of the cable of FIG. 3 taken along the lines of IV—IV showing the wire strands of the conductor encapsulated within the semi-conductor sleeve.

FIGS. 2, 3, and 4 illustrate insulated electrical conductor 12. Conductor 12 includes a cable portion generally designated by numeral 16 and a terminal portion generally designated by numeral 18. Cable 16 includes an electrical conductor 20. Conductor 20 is preferably made of a plurality of electrically conducting wires or strands 22. Although conductor 20 is preferably made of strands 22 it should be understood that conductor 20 may be made as one single conductor (not shown). As a result of tests conducted on various metals it was detemined that silver plated copper wire is preferred as an electrical conductor for strands 22. The silver plate tends to smooth out any surface irregularities on the copper wire to prevent concentrated electrical fields from building up which increase partial discharge occurrences. When silver plated copper strands 22 were properly insulated, as will be explained hereinafter they reduced the partial discharge occurrences to the level previously set forth. Although silver plated copper is preferred for strands 22, it should be understood that other metals such as copper alone and aluminum may also be used if desired.

Surrounding strands 20 is a semi-conductor sleeve 24 which encapsulates strands 22. Semi-conductor sleeve 24 insures that there is not significant electric field stress applied across any trapped gas around conductor 22 by providing a smooth, equipotential field at the semi-conductor 24 and conductor 20 interface, thus, reducing partial discharge occurrences generated as a result of a high voltage field around conductor strands 22 and semi-conductor sleeve 24. Semi-conductor sleeve 24 is preferably made of carbon filled silicone.

Surrounding semi-conductor sleeve 24 is a sleeve of insulating material 26. Preferably, insulator 26 is made of silicone so that a good void free bond can be assured between semi-conductor sleeve 24 and insulator 26. Although silicone is preferred for insulator 26 any insulating material can be used as long as the materals used for semi-conductor 24 and insulator 26 be compatable so that their interface can be made void free. Additionally, silicone is preferred because it is flexible, resistant to partial discharge occurrences, resistant to high temperature, and is easy to work with.

Terminal 18 is an electrical terminal and includes a flange 28 having an aperture 29 extending axially therethrough. A post 30 extends axially from flange 28 and has an aperture 31 extending therethrough and axially aligned with aperture 29 of flange 28. Preferably flange 28 is made an integral part of post 30, however, it may be a separate part secured to post 30 such as by welding if desired. Post 30 includes a threaded portion 32. A spherical electrical conductor 34 in threaded on threaded portion 32 of post 30 when the electrical connection is made to terminal 18 (to be explained later). It is preferred that conductor 34 be spherical because a sphere will disperse the electrical field created at terminal 18. This dispersing of the electrical field reduces the partial discharge occurrences at this point. If an irregular terminal is used the electrical field is concentrated in the area of the terminal and large partial discharges may result therefrom.

Cable 16 is connected to terminal 18 in any conventional manner which provides a true hermetic seal. Preferably, a portion of insulating sleeve 26 and semi-conductor sleeve 24 is stripped away from conductor strands 22, FIG. 3, and strands 22 are inserted through apertures 29 in flange 28 and 31 in post 30. Strands 22 are soldered with alloyed silver 36 to flange 28 and post 30.

FIGS. 1 and 2 illustrate electrical insulator 14 which surrounds a portion of terminal 18 and electrical cable 16. Electrical insulator 14 includes a first sleeve 38 which surrounds a portion of post 30 leaving an exposed portion 40 of post 30 between sleeve 38 and threaded portion 32. Surface 41 butts against flange 28 and preferably, the outer diameter of surface 41 is substantially greater than the outer diameter of flange 28. Sleeve 38 is preferably metal and is secured to post 30 and flange 28 of terminal 18 such as by welding. Sleeve 38 is preferably formed of a highly stable, corrosion resistant alloy having a very high melting point such as Kovar metal being composed substantially of 54 percent Fe, 29 percent Ni, and 17 percent Co.

A second sleeve 42 surrounds flange 28 and a portion 44 of cable 16. Sleeve 42 has an inside diameter substantially greater than the outer diameter of insulation 26 forming a space 46 between portion 44 of cable 16 and sleeve 42. Sleeve 42 includes a stepped portion 47 at substantially the midpoint of sleeve 42 reducing the outer diameter of sleeve 42. Sleeve 42 is made from any type insulating material such as ceramic, however, it is preferred that the insulating material be of high alumina ceramic. Insulating sleeve 42 is bonded to surface 41 of sleeve 38 in any conventional manner.

A third sleeve 48 surrounds a portion of second sleeve 42 at the stepped portion 47 on sleeve 42. Sleeve 48 is formed of the same metal Kovar as sleeve 38 and is bonded to sleeve 42 in any conventional manner.

A connecting flange 52 surrounds a portion of second sleeve 42 adjacent too and abutting third sleeve 48. A cylindrical portion 53 of sleeve 42 extends axially from connecting flange 52. Flange 52 has an outer diameter substantially greater than the outer diameter of sleeve 42 and sleeve 48. A plurality of apertures 56 extend axially through flange 52 and are located near the outer periphery thereof. Face 55 of flange 52 includes a circumferentially extending groove 57 located between apertures 56 and the inner periphery of flange 52. An O-ring 59 preferably made of copper sits within groove 57. Flange 52 is secured to sleeve 48 such as by welding. Flange 52 may be made from any type metal, however, stainless steel is preferred.

Voltage feed-through apparatuses were made in accordance with this invention and tested to determine the amount of partial discharge occurrences that were given off. The first tests were conducted at atmospheric pressure with 20 KVDC applied to terminal 18 for 200 seconds. The results of three tests showed that the partial discharge occurrences were 19, 20 and 83 at levels higher than 1.71 picocoulombs. These results showed that the apparatuses reduced the partial discharge occurrences by a magnitude of $10^4$ over the prior art feed-through described.

A series of tests were conducted on apparatuses that were subjected to a pressure of less than $10^{-5}$ torr. Again 20 KVDC was applied to terminal 18 for 200 seconds. The results are shown in Table 1.

TABLE 1

| TRIAL | TOTAL PARTIAL DISCHARGE OCCURRENCES ≧1 Picocoulomb | >5 Picocoulomb |
|---|---|---|
| 1 | 1 | 1 |
| 2 | 1 | 1 |
| 3 | 3 | 1 |
| 4 | 1 | 1 |
| 5 | 3 | 0 |
| 6 | 3 | 0 |
| 7 | 1 | 0 |
| 8 | 7 | 0 |

From Table 1 it may be readily seen that in all the trials the partial discharge occurrences are well below 5 partial discharges at a charge level of less than 5 picocoulombs. At levels of 1 or less picocoulombs only trial 8 showed partial discharge occurrences above 5. Consequently, apparatus 10 reduces the partial discharge occurrences to a level that is acceptable for obtaining reliable data on the number of partial discharge occurrences by the equipment under test.

Voltage feed-through apparatus 10 may be installed in any type vacuum test chamber (not shown). End 53 of sleeve 42 extends through a wall of the test chamber so that end 62 of conductor 12 extends into the test chamber. Flange 52 fits against the outside wall of the test chamber and is secured to the wall by bolts (not shown) extending through apertures 56 and the wall and is preferably grounded as shown in FIG. 1. O-ring 59 forms a seal between flange 52 and the wall of the vacuum chamber to prevent venting of leaks. End 62 is connected to the equipment to be tested (not shown). Spherical conductor 34 is unscrewed from threaded portion 32 of post 30 and a connector end 64 of a powder cable 66 is placed around portion 40 of post 30. Spherical conductor 34 is screwed on threaded portion 32 to secure end 64 against sleeve 38. Power cable 66 is connected to a conventional power supply 68 which is grounded as shown in FIG. 1. When voltage is supplied by a power supply 68 to the equipment being tested, the voltage will pass into the vacuum chamber via voltage feed-through device 10 with a very low level of partial discharge occurrences so that the partial discharge occurrences can be accurately measured on the equipment under test.

A voltage feed-through apparatus having reduced partial discharge has been disclosed. Obvious modifications and variations of the disclosed embodiment of the invention are possible in light of the above teachings. It is to be understood therefore, that within the scope of the appended claims the invention may be practiced otherwise than as specifically described and illustrated.

Accordingly, the invention having been described in its best embodiment and mode of operation, that which is desired to be claimed by Letters Patent is:

1. Apparatus for feeding voltage through the wall of a container, comprising:

electrical conductor means formed of copper having silver plating surrounding the outer periphery thereof forming a substantially smooth surface for preventing concentrated electrical field buildup;

terminal means connected to said electrical conductor means for applying electrical power thereto from a source outside of said container;

semi-conductor sleeve means surrounding said electrical conductor means for reducing electrical field stress around said electrical conductor means by providing a smooth, equipotential field at said semi-conductor sleeve means and said electrical conductor means interface;

insulating sleeve means surrounding said semi-conductor sleeve means for insulating said electrical conductor means and for providing a substantially void-free bond between said semi-conductor sleeve means and said insulating sleeve means;

a first sleeve formed substantially of 54 percent Fe, 29 percent Ni, and 17 percent Co and surrounding a portion of said terminal means;

a second sleeve formed substantially of high alumina ceramic, said second sleeve being bonded to said first sleeve and surrounding a portion of said insulating sleeve means forming a space therebetween;

a third sleeve formed substantially of 54 percent Fe, 29 percent Ni, and 17 percent Co, said third sleeve being spaced from said first sleeve and surrounding and bonded to said second sleeve; and a flange surrounding a portion of said second sleeve for securing to the wall of the container.

2. The apparatus of claim 1 wherein said flange is formed of stainless steel.

3. The apparatus of claim 1 wherein said terminal means includes:

a threaded portion for connection to an energy source; and spherical means threaded on said threaded portion for dispersing an electrical field created at said threaded portion, thereby reducing partial discharge occurrences at said threaded portion.

4. The apparatus of claim 1 wherein said electrical conductor means are strands of wire.

5. The apparatus of claim 1 wherein said semi-conductor sleeve means is substantially carbon filled silicone.

6. The apparatus of claim 1 wherein said insulating sleeve means is substantially silicone.

* * * * *